US005813708A

United States Patent [19]

Shen

[11] Patent Number: 5,813,708

[45] Date of Patent: Sep. 29, 1998

[54] TUBULAR LATCH WITH A TORSION SPRING DISPOSED THERETO

[76] Inventor: Mu-Lin Shen, No. 32, Lane 76, Sec. 5, Taiwan, Taiwan

[21] Appl. No.: 824,489

[22] Filed: Mar. 27, 1997

[51] Int. Cl.[6] ..... E05C 1/12

[52] U.S. Cl. ..... 292/165; 292/336.3; 70/224

[58] Field of Search ..... 292/163–165, 292/173, 347, 336.3; 70/224, 479

[56] References Cited

U.S. PATENT DOCUMENTS

| | | | |
|---|---|---|---|
| 2,985,478 | 5/1961 | Russell | 292/1 |
| 3,075,796 | 1/1963 | Russell et al. | 292/1 |
| 5,067,758 | 11/1991 | Fann et al. | 292/347 |
| 5,265,924 | 11/1993 | Kim | 2923/347 |
| 5,481,890 | 1/1996 | Millman | 292/336.3 |
| 5,564,296 | 10/1996 | Theriault | 292/165 |
| 5,593,193 | 1/1997 | Heim | 292/336.3 |
| 5,666,833 | 9/1997 | Gao et al. | 292/336.3 |

*Primary Examiner*—Lloyd A. Gall
*Assistant Examiner*—Tuyet-Phuong Pham
*Attorney, Agent, or Firm*—Michael A. O'Neil

[57] ABSTRACT

A tubular includes a latch body having a cam hole, a first member disposed to the latch body, a second member rotatably disposed to the first member, a torsion spring disposed to the second member with one of two legs of the torsion spring being engagedly received with in a first stop extending from the first member and the other leg being engagedly received with in a second stop extending from the second member, and a spindle having one end thereof extending through the cam hole and a hole of the second member having the same shape of inner periphery as that of the cam hole of the latch body such that when a lever connected to the spindle is rotated, the lever returns to its original position because of the torsion spring.

3 Claims, 3 Drawing Sheets

TUBULAR LATCH WITH A TORSION SPRING DISPOSED THERETO

BACKGROUND OF THE INVENTION

1. Field of the Invention

The present invention relates to a tubular latch and, more particularly, to a tubular latch having a torsion spring disposed thereto so as to prevent levers from sagging.

2. Brief Description of the Prior Art

Locks for doors need to be easily installed, have a simple structure and be cheap. An invention of Applicant is shown in U.S. Pat. No. 5,177,987 which has a complicated structure and higher price although the disclosed key-in-lever type door lock has some improvement advantages. The kind of key-in-lever type door lock is not used for doors such as in communal entrances where many people pass through and there is no need for a lock, the door may just keep out bad weather etc. The present invention intends to provide an improved tubular latch which has torsion springs disposed thereto so that levers return back to their original position by the torsion spring so as to mitigate and/or obviate the above-mentioned problems.

SUMMARY OF THE INVENTION

The present invention provides a tubular latch which comprises a latch body having one end with a throw reversibly received therein and a cam hole defined therethrough near the other end of the latch body.

A first member securely disposed to the latch body has a ring portion with a first hole defined therein and a plate extends radially from the ring portion. A first stop extends laterally from the first member and has a first recessed portion defined in an under edge thereof.

A second member disposed to the first member has a second hole defined therein by an inner periphery which has the same shape as that of the cam hole and shares the same axis with the cam hole and the first hole. At least two retaining lugs and a second stop respectively extend laterally from the second member wherein the second stop has a second recessed portion defined in a top edge thereof.

A torsion spring is retained between the retaining lugs and the second stop. One of two legs of the torsion spring is engagedly received with in the first recessed portion and the other leg of the torsion spring is engagedly received with in the second recessed portion.

A spindle has one end thereof inserted into the cam hole of the latch body by extending the spindle through the second hole of the second member and the first hole of the first member. The other end of the spindle is securely connected to an operating member.

It is an object of the present invention to provide a tubular latch having a torsion spring disposed thereto so that the lever of the tubular latch returns back to its original position after being rotated.

It is another object of the present invention to provide a tubular latch which has simple structure so that it is suitable to be installed to doors which do not requires locks.

Other objects, advantages, and novel features of the invention will become more apparent from the following detailed. description when taken in conjunction with the accompanying drawings.

DETAILED DESCRIPTION OF THE PREFERRED EMBODIMENT

Figure 1:
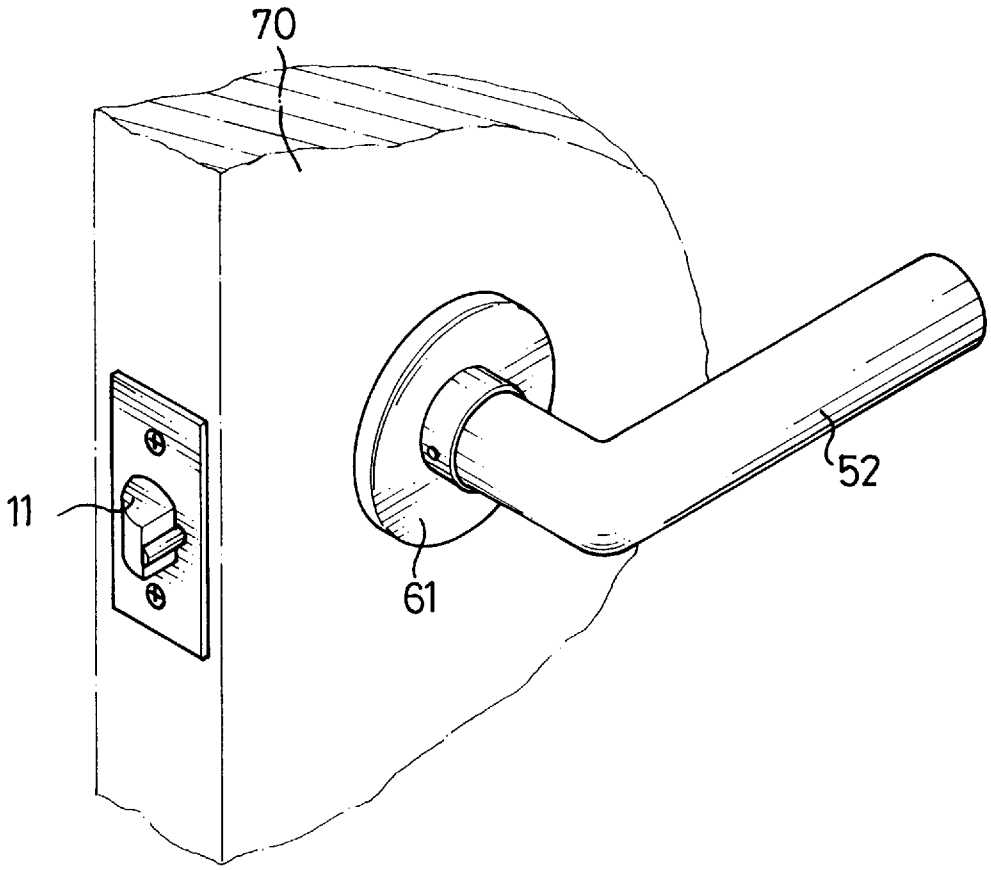
FIG. 1 is a perspective view of a tubular latch in accordance with the present invention disposed to a door.
Figure 2:
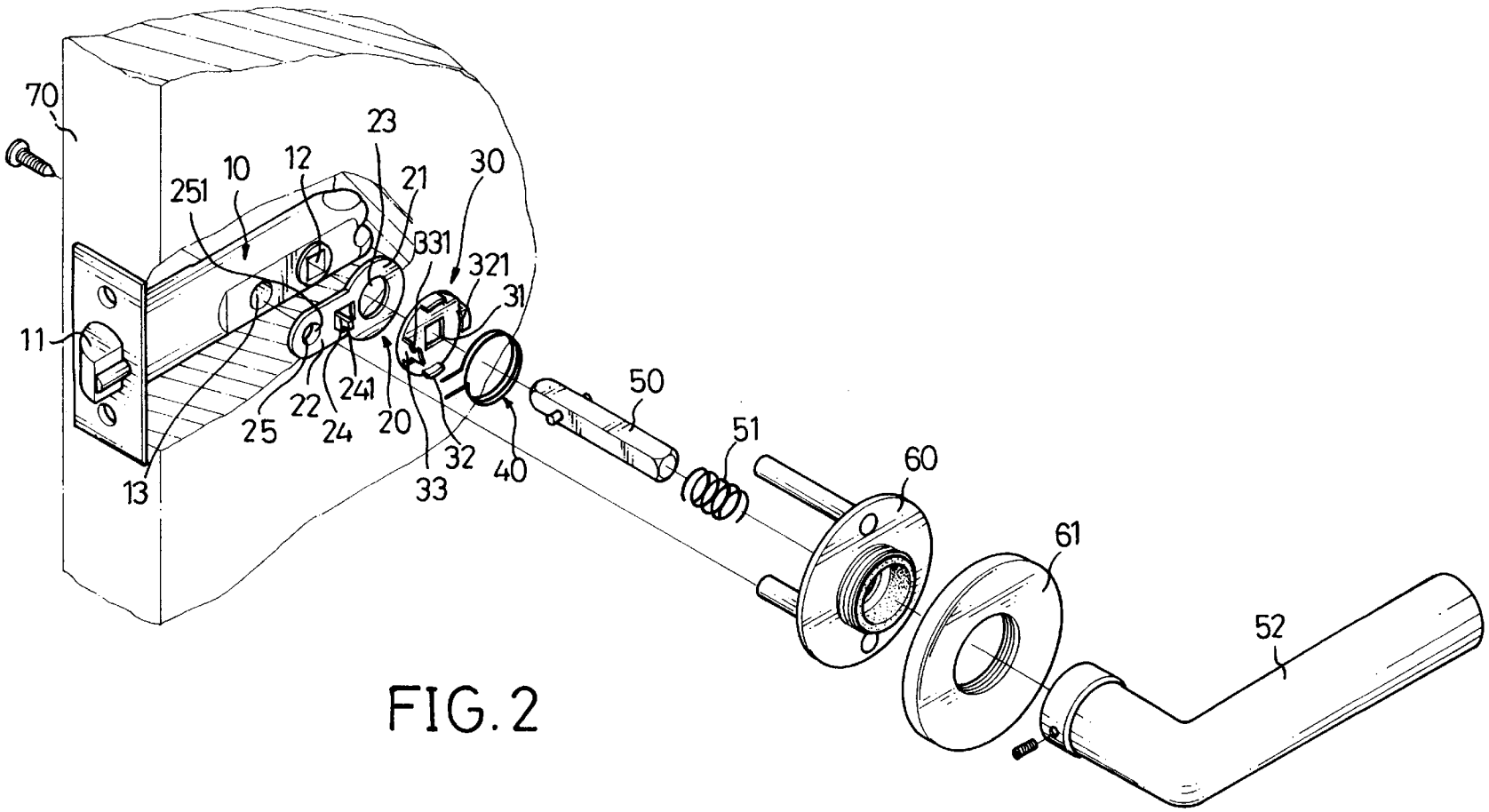
FIG. 2 is an exploded view of the tubular latch in accordance with the present invention.

Referring to the drawings and initially to FIGS. 1 and 2, a tubular latch in accordance with the present invention for a door 70 generally includes a latch body 10 which has one end with a throw 11 reversibly received therein and a cam hole 12 is defined therethrough near a second end of the latch body 10 and a third hole 13 is defined in a middle portion thereof. An inner periphery defining the cam hole 12 is rectangular in shape. A first member 20 has a ring portion 21 and a plate 22 extending radially from the ring portion 21. A first hole 23 is defined in the ring portion 21 and a fourth hole 25 is defined through the plate 22 wherein an annular lip 251 defining the fourth hole 25 extends from the plate 22 and toward the latch body 10 so as to be inserted into the third hole 13 of the latch body 10 to prevent the first member 20 from co-rotation with a lever 52 which operates the latch body 10. A first stop 24 extends laterally from the plate 22 and toward opposite the latch body 10. The first stop 24 has a first recessed portion 241 defined in an under edge thereof.

A second member 30 has a second hole 31 defined therein by an inner periphery which is the same shape as that of the inner periphery defining the cam hole 12 and shares the same axis with the cam hole 12 and the first hole 23. Three retaining lugs 32 and a second stop 33 respectively extend laterally from the second member 30 wherein the second stop 33 has a second recessed portion 331 defined in a top edge thereof.

A torsion spring 40 is retained between the retaining lugs 32 and the second stop 33 wherein one of two legs of the torsion spring 40 is engagedly received within the first recessed portion 241 and the other leg of the torsion spring 40 is engagedly received within the second recessed portion 331. One of the retaining lugs 32 of the second member 30 has an end plate 321 extending laterally from a free end thereof so that the torsion spring 40 will not separate from the second member 30 and be retained at its position when the torsion spring 40 is operated.

A spindle 50 having a rectangular-shaped cross section has a first end thereof received the cam hole 12 of the latch body 10 by the spindle 50 being extended through the second hole 31 of the second member 30 and the first hole 23 of the first member 20. A second end of the spindle 50 has a spring 51 mounted thereto and is securely connected to the lever 52. A rose 60 and bushing 61 are respectively disposed to the door 70 and the spindle 50 extends from the rose 60 and the bushing 61 for engagement with the lever 52.

Figure 3:
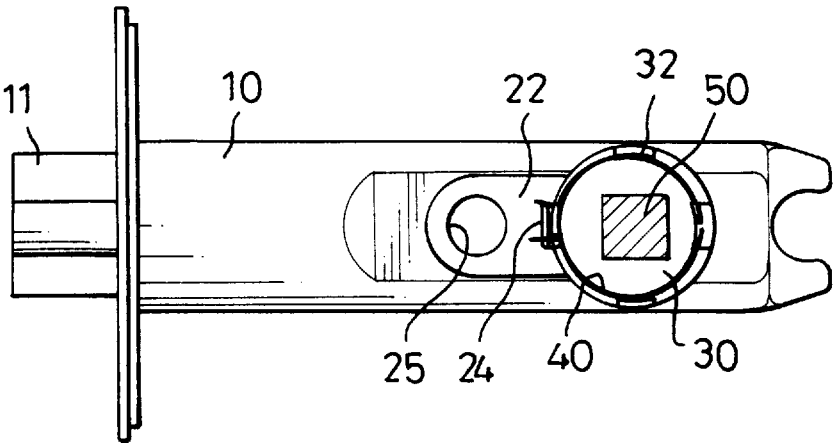
FIG. 3 is a side elevational view, partly in section, of the tubular latch when the spindle is not rotated.
Figure 4:
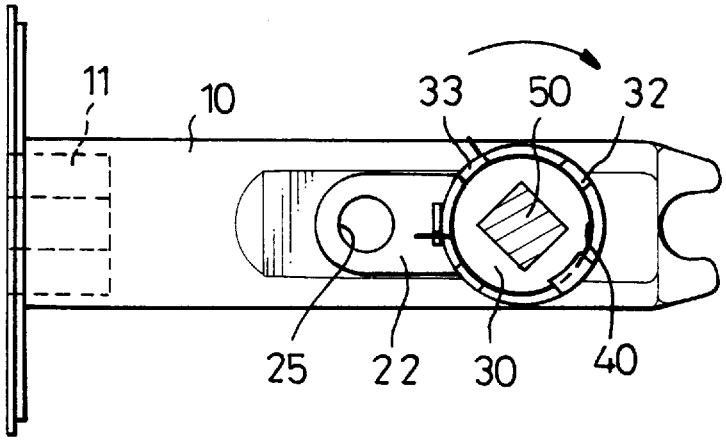
FIG. 4 is a side elevational view, partly in section, of the tubular latch when the spindle is rotated.

Refering to FIGS. 3 and 4, when the lever 52 is rotated clock-wise to retract the throw 11, the spindle 50 together with the second member 30 is rotated and the torsion spring 40 is actuated with the leg of the torsion spring 40 engagedly received within the second recessed portion 331. The torsion spring 40 moves with the second stop 33 so that whenever the second stop 33 is moved, the leg of the torsion spring 40 will not be separated from the second stop 33. When the lever 52 is released, it then returns to its original position as shown in FIG. 3 by the force of the torsion spring 40. Similarly, the lever 52 could be rotated counter-clock-wise.

Accordingly, the tubular latch in accordance with the present invention has a simple structure to make the lever 52 return after being rotated.

Although the invention has been explained in relation to its preferred embodiment, it is to be understood that many other possible modifications and variations can be made without departing from the spirit and scope of the invention as hereinafter claimed.

What is claimed is:

1. A tubular latch comprising:

a latch body having one end with a throw reversibly received therein, a cam hole defined therethrough near a second end of said latch body and said latch body having a first hole defined in a middle portion thereof;

a first member having a ring portion having a second hole defined therein and a plate extending radially from said ring portion, said plate having a third hole defined therethrough and an annular lip extending therefrom and toward said latch body wherein said annular lip defines said third hole and is inserted into said first hole of said latch body, a first stop extending laterally from said first member and having a first recessed portion defined in an under edge thereof;

a second defined member having a fourth hole defined therein by an inner periphery and which has the same shape of that of an inner periphery defining said cam hole and shares the same axis with said cam hole and said second hole, at least two retaining lugs and a second stop respectively extending laterally from said second member;

a torsion spring retained between said retaining lugs and said second stop, one of the two legs of said torsion spring engagedly received within said first recessed portion and the other leg of said torsion spring disposed on said second stop, and a spindle having one end thereof inserted into said cam hole of said latch body by said spindle being extended through said fourth hole of said second member and said second hole of said first member and, a second end of said spindle securely connected to an operating member.

2. The tubular latch as set forth in claim 1 wherein one of said retaining lugs of said second member has an end plate extending laterally from a free end thereof so as to retain said torsion spring in position when said torsion spring is operated.

3. The tubular latch as set forth in claim 1 wherein said second stop has a second recessed portion defined in a top edge thereof so as to receive one of two said legs of said torsion spring.

* * * * *